US005153034A

United States Patent [19]

Telchuk et al.

[11] Patent Number: 5,153,034

[45] Date of Patent: Oct. 6, 1992

[54] PAINT SPRAY BOOTH WITH PLENUM MEANS OF REDUCED CROSS SECTION AND METHOD OF OPERATING THE SAME

[75] Inventors: Steve E. Telchuk, Mundelein; Leslie H. Brown, Carol Stream, both of Ill.

[73] Assignee: Binks Manufacturing Company, Franklin Park, Ill.

[21] Appl. No.: 528,107

[22] Filed: May 23, 1990

[51] Int. Cl.[5] ..... B05D 1/02; B05C 15/00

[52] U.S. Cl. ..... 427/421; 55/241; 55/DIG. 46; 118/326; 118/DIG. 7; 261/112.1; 427/424; 454/49

[58] Field of Search ..... 118/326, DIG. 7; 98/115.2; 55/240, 241, DIG. 46; 427/421, 424; 261/112.1, 118, DIG. 54

[56] References Cited

U.S. PATENT DOCUMENTS

| | | | |
|---|---|---|---|
| 3,170,384 | 2/1965 | Krantz et al. | 98/115.2 X |
| 4,328,012 | 5/1982 | Telchuk, Jr. et al. | 98/115.2 X |
| 4,399,742 | 8/1983 | Dobias | 98/115.2 |
| 4,515,073 | 5/1985 | Dorsch et al. | 98/115.2 |
| 4,537,120 | 8/1985 | Josefsson | 98/115.2 |
| 4,700,615 | 10/1987 | Napadow | 55/DIG. 46 |

*Primary Examiner*—Richard L. Chiesa

*Attorney, Agent, or Firm*—Juettner Pyle & Lloyd

[57] ABSTRACT

A paint spray booth apparatus and method, particularly for automated paint applications, is illustrated and disclosed. The booth has a spray painting chamber and a plenum thereabove. Unlike prior art booths, the plenum of the present invention provides air flow only where needed to control overspray, and generally the plenum is only 60%, or less, in width or cross-section than the prior art, full ceiling width plenums. In carrying out the method of the present invention air is supplied from the plenum to the spray painting chamber only where needed to control overspray so that consequently the quantity of air utilized is substantially less than in prior art booths with air flow from their full width plenums. In certain booths where painting occurs on both sides of the booth, it is advantageous to provide the plenum in the form of two or dual plenums, each offset from the center of the booth.

13 Claims, 4 Drawing Sheets

PAINT SPRAY BOOTH WITH PLENUM MEANS OF REDUCED CROSS SECTION AND METHOD OF OPERATING THE SAME

DISCLOSURE

This invention relates to paint spray booths and more particularly to a method and apparatus for supplying air to an automated paint spray booth to control overspray formed in the booth during a painting operation.

BRIEF DESCRIPTION OF THE PRIOR ART

Heretofore downdraft paint spray booths have been provided with plenums, usually above the ceiling of the booth and running the full width of the booth. Air was generally emitted from the entirety of plenum into the painting chamber of the booth, moved in a downward direction around the article to be painted, wherein it picked up the drying solvents and paint overspray from the painting operation and carried them out the bottom of the booth for treatment to remove the overspray, usually with a water wash. While the prior art plenums worked well, ever tightening environmental requirements imposed increased restrictions. For example, while heretofore it had been acceptable to use on an average of approximately 100 cubic feet of air per minute per square foot of booth floor area, it is now desirable for automatic spray painting booths to use only 60 to 75, or less, cubic feet per minute per square foot of booth length. Likewise water flow requirements have been reduced from 70 gallons per minute per lineal foot of booth to 50 to 35, or less, gallons per minute per lineal foot. Of course the amount of water needed is also related to the air flow so that as the amount of air is reduced, the amount of water is also reduced. These reduced air requirements are only for automated spray painting booths where no painters are employed in the booths, the painting being done by automatic machines or robots.

However, before the overspray can be removed from the air with the wash water, it must first be captured by the downflowing air from the plenum. In particular where articles, such as automobile parts, are being painted on a production basis, such as when carried by a conveyor line, it is essential that the overspray generated or created while painting one portion of a part not contaminate the portions of that part previously painted or yet to be painted or the adjacent parts previously painted or yet to be painted. While this was not difficult to do with the prior permitted copious air flow rates, with the reduced air flow rates, it becomes more difficult to accomplish. Also it is known to vary the cross-sectional area in a paint spray booth, using a wider area for the entire portion where the actual painting is done and a smaller area where no painting is done, such as is shown in U.S. Pat. Nos. 4,241,646, 4,354,451 or 4,575,005.

SUMMARY OF THE INVENTION

The present invention comprises plenum means or structure for an automated paint spray booth wherein air flow is provided from the plenum only over those portions of the booth where painting occurs and overspray is generated to control the overspray, other portions of the booth having little or no air flow. The present invention is totally unlike the prior art booth plenum wherein the plenum generally ran the length and the full width of the booth ceiling. Thus unlike prior art booths where the plenums was of 40% or greater in cross section, compared to the cross section of the booth's spray chamber, the plenum of the present invention is considerably smaller, say about 25%, or less. Where the automated spray painting booth is intended to be used to conduct spray painting operations on both sides of the articles to be painted and/or the tops of the articles, the plenum means, preferably, is in the form of a pair of smaller cross-section or width (compared to the single prior art full width ceiling plenum) plenums which run the length of the booth. Each of the dual plenums is offset from the center line of the booth toward the side to be more over the parts of the articles to be painted and where the overspray is generated.

Additionally, means are provided to control the amounts of air flow from each portion of the plenum, which may take the conventional form of a plurality of pairs of overlying, fenestrated, slidable plates spaced along the length of the booth. Thus by separately adjusting the pairs of plates air flow from the plenum of the present invention can be tailored or controlled as desired, providing, for example, no flow in some areas by relatively positioning the plates to cut off flow, maximum flow in other areas by relatively positioning the plates so the fenestrations coincide, or somewhere in between to provide a desired in between flow. Further in order to maximize the effectiveness of the flow, conventional air directing means such as scoops or louvers may be utilized to help direct the flow to control overspray.

Further, to help reduce the air flow needed the painting chamber may be made wide enough to contain the articles being painted and, if used, their conveyor but not wide enough to contain the automated painting machines. These machines can be contained in bays at the side of the spray chambers, the bays being of a length sufficient to contain the automated spray painting machine but less than the length of the booth.

In carrying out the method of the present invention, the reduced quantity of air flow (compared to prior used air flows) still adequately controls overspray by reducing or eliminating air flow from those portions of the plenum where it is not needed to control overspray and providing air flow (at or near prior air flow velocities and not less than 300 feet per minute) from those portions of the plenum where it is needed to control overspray. Thus, while the total air flow in the booth is substantially reduced, and the concomitant water flow is, of course, also reduced, this reduced air flow (though still at good velocity), as it is permitted only where needed, still adequately controls overspray. Further as the automated painting spray booth having a plenum of the present invention utilized less air flow, it is capable of being used as a recirculating or nearly recirculating booth (say 15% or less make up air), resulting in greatly reduced atmosphere emissions and air conditioning costs, such as treating, cooling, humidifying or dehumidifying and filtering costs.

It is a primary object of the present invention to provide an automated spray painting booth plenum for use with reduced air flow.

It is a concomitant object of the present invention to provide an automated spray painting booth plenum which results in a reduced water flow.

It is yet another object of the present invention to provide an automated spray painting booth with a plenum suitable for essentially recirculating all of the booth's air.

It is still a further object of the present invention to provide an automated spray painting booth plenum with a reduced cross-section which is capable of operating with reduced air flow.

Still a further object of the present invention is to provide a spray booth having dual plenums of a width of about 60% or less than the width of the booth's ceiling.

Yet another object of the present invention is to provide a method of providing air to an automated paint spraying booth so that it may be operated with reduced air flow but yet control overspray.

These and other objects of the present invention will become apparent from the accompanying drawings and the following written description.

DESCRIPTION OF THE PREFERRED EMBODIMENTS

Figure 1:
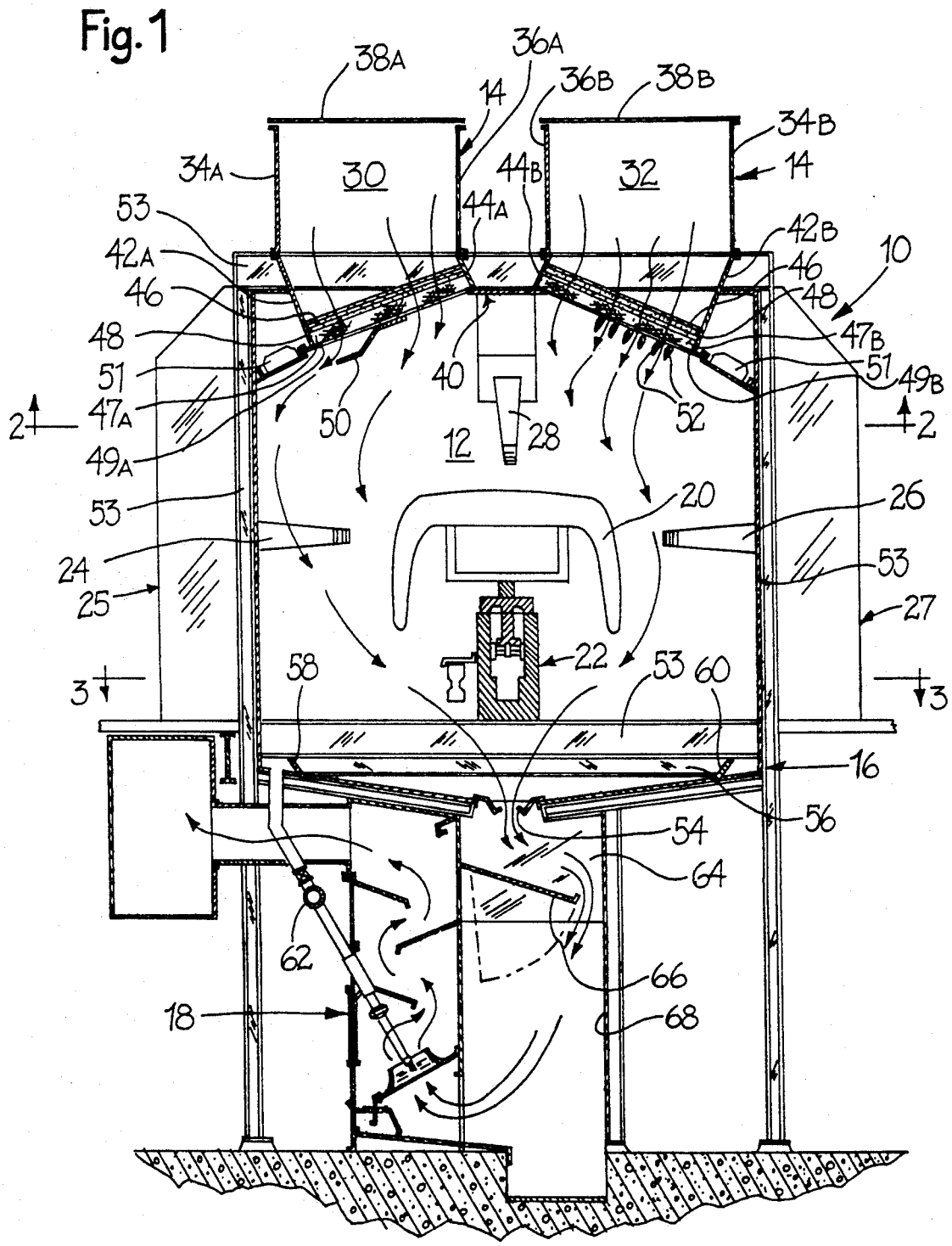
FIG. 1 is a cross-sectional view of a first embodiment of the booth having a plenum of the present invention.

Referring to FIG. 1, a first embodiment of an automated spray booth 10 having a plenum of the present invention is shown. Generally, the booth 10 comprises a spray painting chamber 12 in which the painting occurs. The chamber 12 is located below an air supply in the form of plenum means 14 and is located above a water washed subfloor 16 and an eliminator section 18 for removing paint overspray from the air.

As is shown, the articles to be painted, such as automotive parts 20 are moved through the painting chamber 12 by a conveyor 22. Automatic spray painting machines 24, 26 and 28 are located at the two sides and the top of the chamber 12 to automatically paint the parts 20 as they move by. The two side machines 24 and 26 are housed in separate bays 25 and 27 opening onto the spray chamber 12. While automatic machines 24, 26 and 28 are shown, any type automated spray painting equipment, such as robots, could also be used. However, as the booth is intended for use at a reduced air flow, human painters should not be used in the booth, unless the air supply is substantially increased to that required for the use with men present therein, or they are otherwise protected.

In more particular, in this instance as spray painting is to take place on both sides of chamber 12 of the booth 10, the plenum means 14 is in the form of two or dual plenums 30 and 32. Each of the plenums 30 or 32 is connected to a conditioned air source (not shown) and is positioned above the painting chamber 12 offset (say 4 to 6 feet or so between the booth center line and the centerline of each plenum) toward one or the other side of the booth 10. Plenum means 14 comprise side walls 34A or 34B and 36A or 36B and is closed at the top by roof panels 38A or 38B. The plenums extend downward to connect with and discharge through the ceiling 40 of the painting chamber 12. The ceiling 40 of the booth 10 stops short of and does not extend over the bays 25 and 27, the top of the bays having their own closures. As is shown, angular lower side walls 42A or 42B and 44A or 44B connect into the panels forming the ceiling 40 of the spray painting chamber 12 to provide flow of air from the plenum means 14 into the chamber 12.

Unlike a prior art booth which had a plenum which was essentially the full width of the booth's ceiling, the plenum means 14 of the present invention (plenums 30 and 32) are about 60% or less of the width of the booth's ceiling and only about 60% or less in cross-section compared to prior art full ceiling width plenum. Likewise, the plenum of the present invention is about 25% or less of the cross section of the painting chamber 12, whereas in prior art booths the plenum was of a much greater percentage. The reduced cross-section and width of the plenum means 14 of the present invention helps maintain air velocity in the plenums and air flow velocity from the plenums into the chamber 12. Maintaining a high air velocity also helps in controlling paint overspray as the latter is less likely to freely migrate in the presence of a high speed controlling air flow.

In order to control the air flow from the plenums, a pair of overlying fenestrated plates 46 and 48 are used, the use of such pair of plates being conventional. However, to give control along the length of the booth, a plurality of such pairs of plates are provided along the length of the booth. Each cooperating pair of plates 46 and 48 is only a foot or so wide (measured along the length of the centerline of the booth). Each of the plates 46 and 48 have a plurality of openings therein which may be aligned with similar openings in the other cooperating plate to provide maximum air flow from the plenum means, or completely misaligned to close off air flow from the plenum means. Of course, any in between position can be selected to give a desired flow anywhere in between the maximum and zero. As the pairs of plates may be individually adjusted the air flow from the plenums can be exactly tailored as needed to control the paint overspray generated during the paint application.

Figure 2:
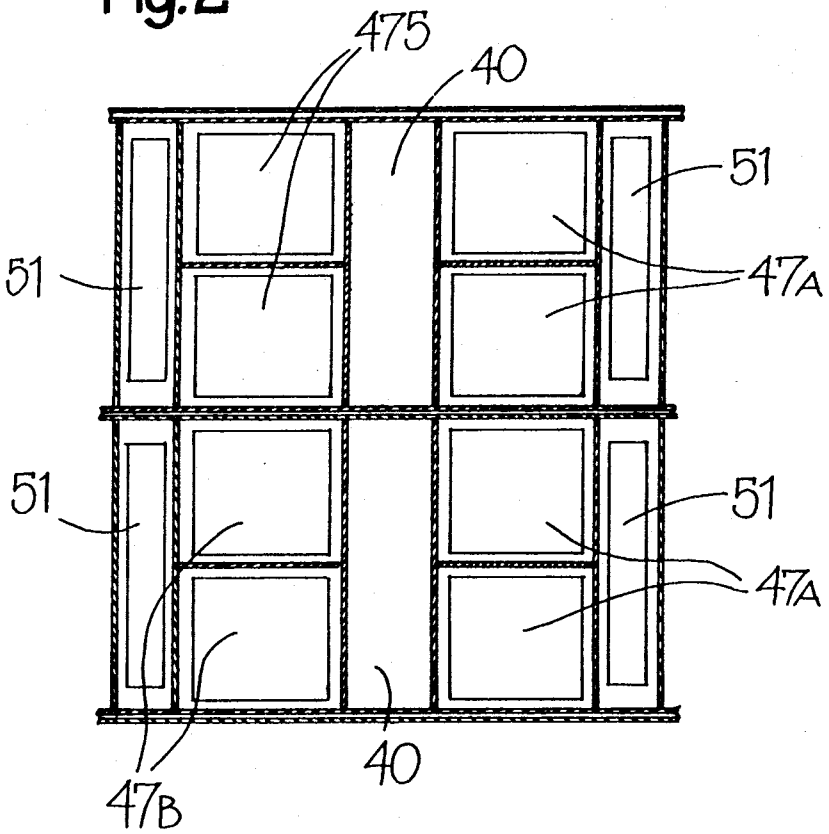
FIG. 2 is a cross-sectional view taken along the lines 2—2 of FIG. 1.

As shown in FIGS. 1 and 2, beneath each of the plenums 30 and 32 air filters 47A or 47B are provided to filter the air flow from the pairs of fenestrated plates. Each of the filters 47A or 47B is held in removable frames 49A or 49B, the frames being pivotal downward to facilitate filter replacement. As is shown, light fixtures 51 are provided at the side edges of the ceiling for lighting within the booth.

As is conventional, the weight of the plenums and booth ceiling are carried by various vertical and horizontal structural beams 53. Where the beams 53 pierce the plenums, they are, of course, sealed to provide a reasonably air tight fit.

To further control the air flow in certain locations, such as near or above the side machines 24 or 26 doing the painting, one or more scoops 50 can be provided to direct at least some of the air from the plenums, out toward the side and then down, around the back side of the side machine 24 or 26, and down through the subfloor 16. This action helps control the overspray and keeps the side machines essentially free of overspray so less maintenance is needed.

To further control the air flow in certain other locations, such as in the vicinity of the top machine 28, spraying the tops of articles, conventional louvers 52 can be provided to direct the air flow where needed. The louvers can be individually adjusted to, again, give the flow pattern desire to control overspray.

As this booth operates with reduced air flow, concomitantly less water flow on the subfloor 16 and in the washer section 18 is required. The booth 10 of the present invention also lends itself well to recirculating operation wherein all or most (say 85% or more) of the air is washed, treated and recirculated to the plenums. Recirculation operation can provide considerable savings, particularly where the air has to be was first heated as in cool weather, or cooled as in warm weather, or otherwise treated.

Figure 3:
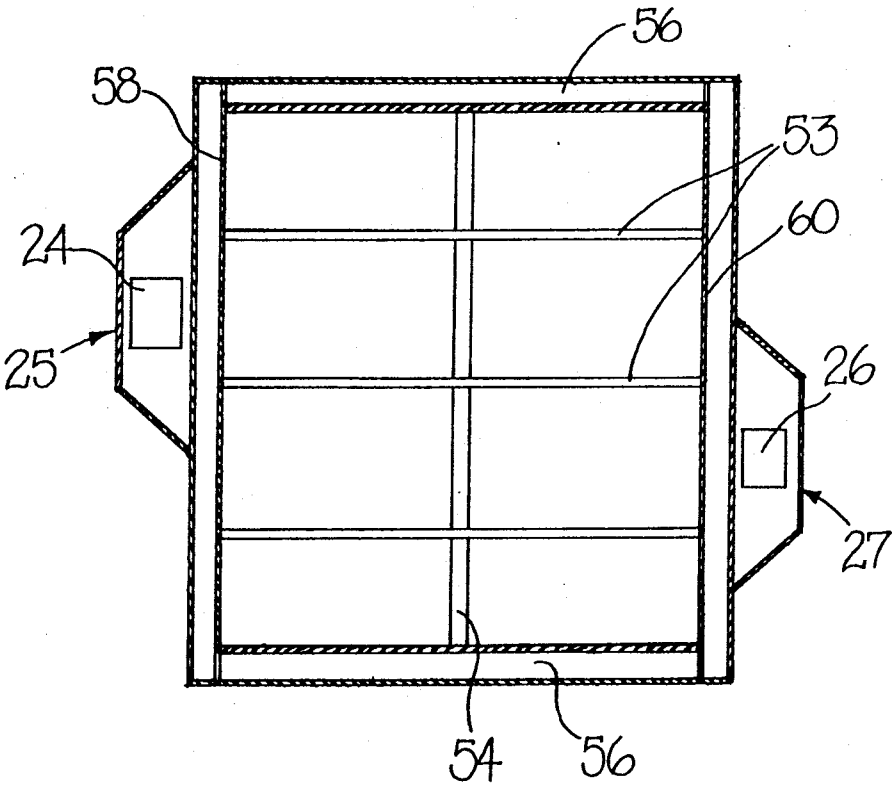
FIG. 3 is a cross-sectional view taken along the lines 3—3 of FIG. 1.

The subfloor 16 of booth 10 shown in FIGS. 1 and 3, is similar to that described in U.S. Pat. Nos. 4,328,012 and 4,521,227 in that it has a central slot 54 therein through which the air from the painting chamber 12 is withdrawn (by such means as exhaust fans not shown) to the washing or eliminator section 18. Also, the subfloor can be similar to that shown in U.S. Pat. No. 4,726,287 in that a cross through 56 can be provided to transfer water from one side of the subfloor 58 to the other side of the subfloor 60. The water is supplied to the one side of the subfloor 58 from the supply pipe 62. The specifications and drawings of U.S. Pat. Nos. 4,328,012, 4,521,227 and 4,726,287 giving the details of the subfloor construction are incorporated herein by reference.

The paint ladened air, after partial cleaning in the slot 54, is drawn by the same exhaust fans (not shown) into the washer or eliminator section 18 which in this instance has an air nozzle-water nozzle washer 64 like that described and illustrated in U.S. Pat. Nos. 4,239,512 and 4,399,742 and in more particular is described in the copending U.S. patent application Ser. No. 528,109, entitled "Spray Paint Booth Washer", filed on the same day as the present application in the names of the inventors, Steve E. Telchuk, Leslie H. Brown and Frank L. Dobias and assigned to the same assignee as the present application. The specification and drawings of that U.S. patent application Ser. No. 528,109, describing the specifics of the washer or eliminator section 18 is incorporated herein by reference.

As is shown in FIG. 1, the air flow into the subfloor should compliment the air flow from the plenums. Where desired, vertical panels 64 can be provided from the slot level to below the pivoting baffle 66 to isolate air flow in one section of the booth from another adjacent section of the booth. Then the individual hinged baffles 66 may be moved toward or away from its cooperating vertical wall 68 to control the rate of air flow through that segment of the booth. While a full booth has not been built and tested yet, it is contemplated that the horizontal spacing between adjacent vertical panels 64 might be about 5 feet and the baffles 66 of a width of say 5 feet, but these dimensions could be more or less as desired or needed to provide control over the overspray.

In operation, the air flow from the plenums 30 and 32 would be adjusted to keep the overspray from the painting operation in the locales desired, and as much air would be permitted to flow from the plenums 30 and/or 32 at the desired locations and to flow into the slot 54 as was necessary to accomplish the task. At other locations, as the overspray is already under control and no air is needed for men, as none are in the booth during operation, little or no air flow would be permitted. Thus, the booth 10 with the present invention can be operated with substantially less air flow, say 60 to 75, or less cubic feet per minute per square foot of booth, compared to the prior art 100 cubic feet per minute per square foot of booth. Consequently, water flow needed to clean the air discharged from the spray chamber 12 of the booth 10 is, likewise, reduced 30% or more from say 70 gpm per foot of length to 50 to 35 gpm per foot of length.

Thus, the present invention results in great savings in installation expense as smaller capacity air and water handling equipment is needed, in operation as less power is consumed, and in total pollution emissions as there is less air and water to treat. Consequently, the smaller volumes of water and air that needs treatment can be more easily cleaned and cleaned to a greater degree than was practical with prior art, high air flow plenums.

Figure 4:
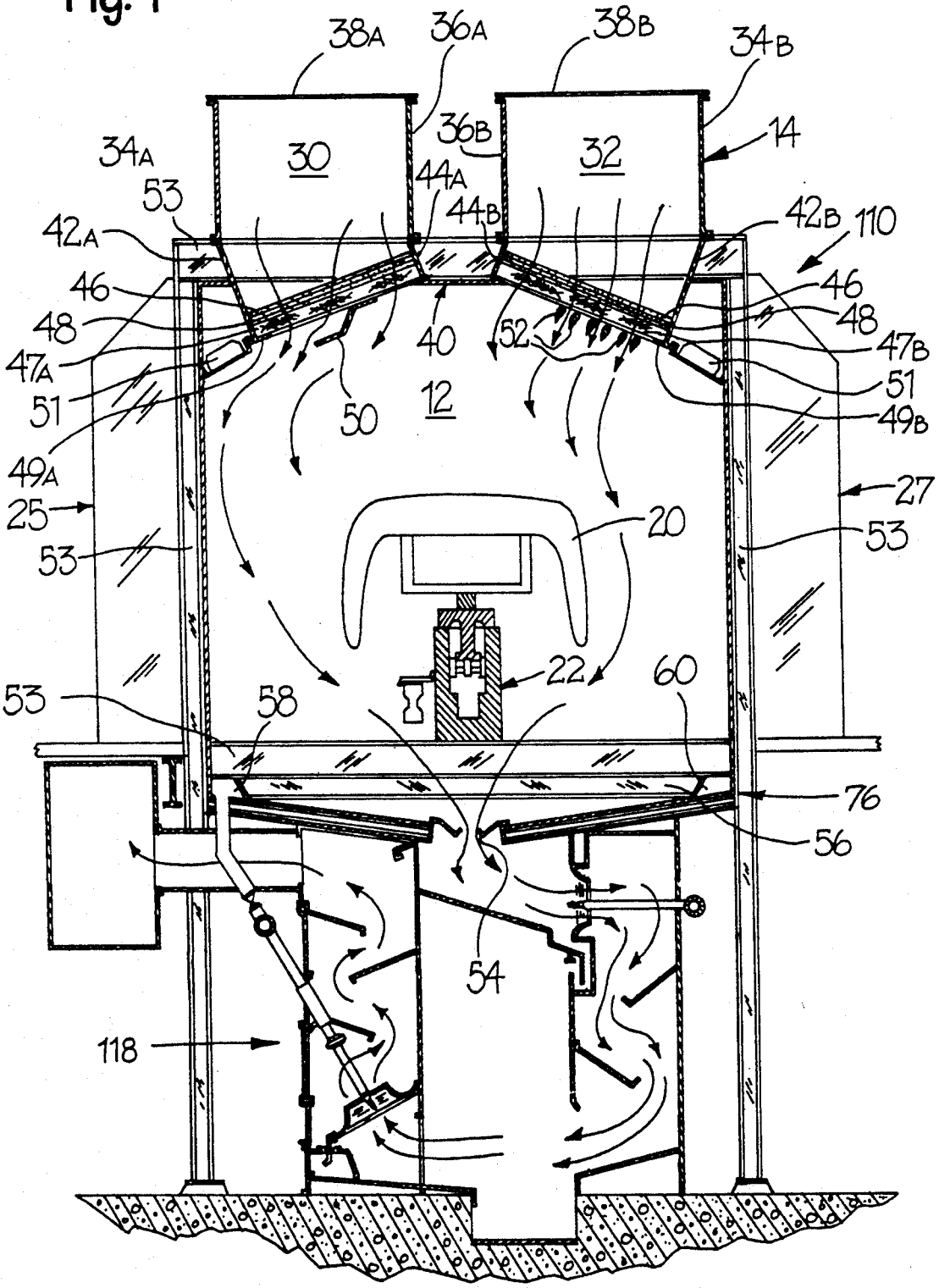
FIG. 4 is a cross-sectional view of a second embodiment of booth having a plenum of the present invention.

Referring to FIG. 4, a second embodiment booth 110 is shown and to the extent similar to embodiment 10, will be given the same reference numerals. Above the subfloor 16, embodiment 110 is the same as embodiment 10, but below the subfloor 16 the washer section 118 is like that referred to in FIG. 2 of the copending U.S. patent application Ser. No. 528,109.

Figure 5:
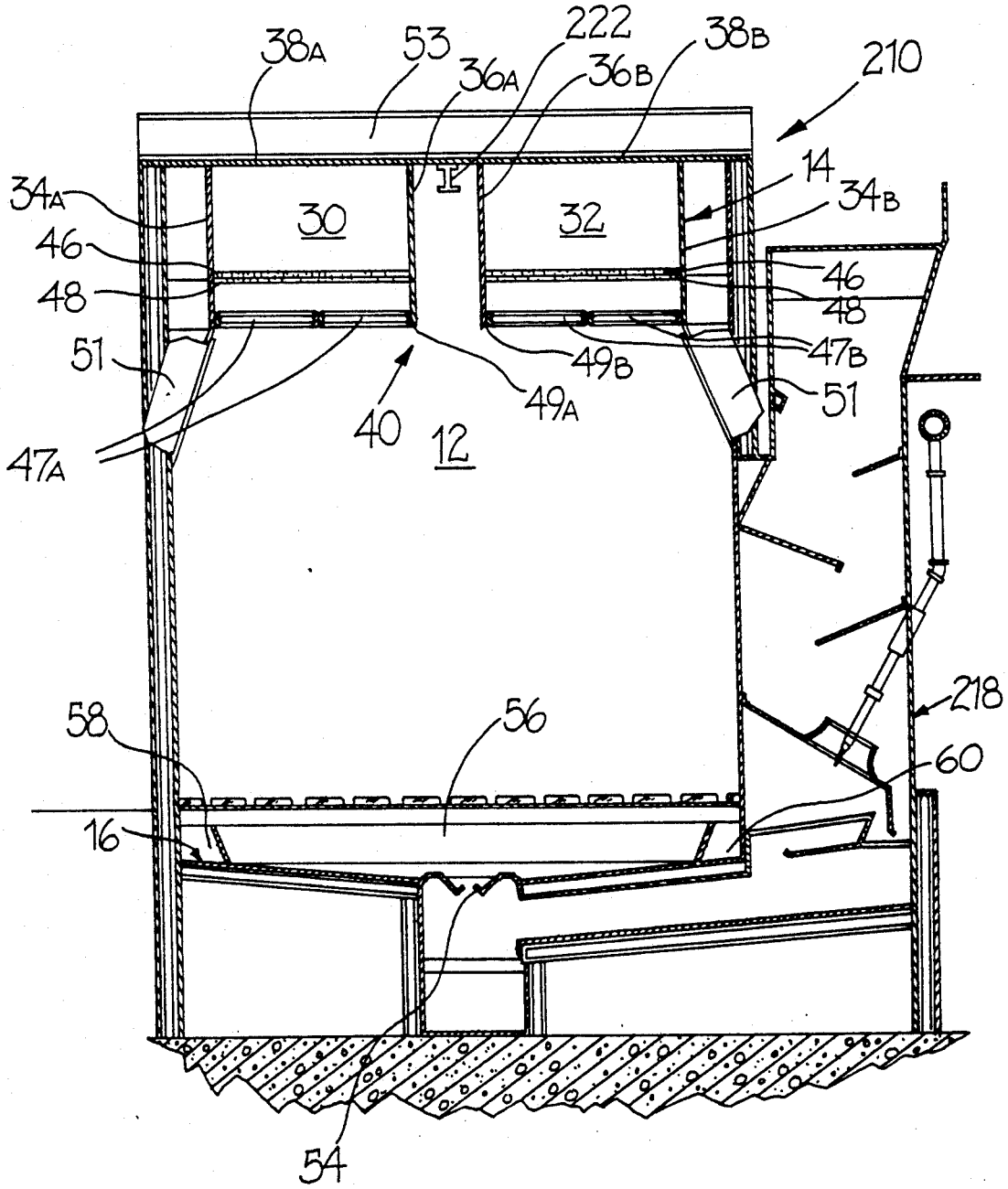
FIG. 5 is a cross-sectional view of the third embodiment of booth having a plenum of the present invention.

Referring to FIG. 5 a third embodiment booth 210 is shown and to the extent similar to the embodiment 10, will be given the same reference numerals. For simplicity the automated painting machines, articles to be painted and conveyor have been omitted from FIG. 5. Above the subfloor 16 embodiment 210 is somewhat similar to the embodiments 10 and 110, but below the subfloor shows a cleaning section 218 at the side of the subfloor, instead of down below the subfloor. Another difference is that, instead of having a floor conveyor, the booth 210 has a ceiling conveyor or trolley system along which the articles to be painted can be moved. Thus, the trolley track 222 is located between the dual plenums and is carried by the uppermost horizontal structural support beam 53 supporting the top of the booth.

As can be seen, the concept of the present invention can be adopted to many type booth configurations whether having eliminator or washing sections below the subfloor, at the side, or elsewhere, and can be utilized with various type subfloors or washer or eliminator arrangements, such as shown in any of the above mentioned U.S. Patents, be they of the baffle type or air nozzle-water nozzle type or other type. For example, the present invention could be utilized with any of the subfloors or washer sections shown in the above mentioned U.S. Patents, or in the copending U.S. patent application Ser. No. 528,109 entitled "Paint Spray Booth Washer".

While the preferred embodiments show dual plenums, if the present invention is to be used in a booth configuration where painting takes place on but one side of the booth, a single small plenum on that side of the booth could be provided.

While several preferred embodiments of the apparatus and method of the present have been illustrated and described herein and/or portions thereof incorporated herein by reference, from the foregoing it should be understood that variations, modifications and equivalent structures or steps fall within the scope of the appended claims.

We claim:

1. In an automated paint spray booth using air flow and water flow and subsequently cleaning with the water flow the paint laden air created during spray painting an article, the booth having a spray painting chamber with a ceiling, a length and a floor area, and at least one automated spray painting machine therein, the improvement comprising means for moving air into said spray painting chamber at a total volume of 75, or less, cubic feet per minute per square foot of booth floor area and high velocity of 300, or more, feet per minute, plenum means located above and in communication with said means for moving air and said spray painting chamber for supplying substantially the total air flow into said spray painting chamber, said plenum means having a total cross-sectional area of 251%, or less, of the cross-sectional area of the said spray painting chamber to maintain the high velocity of the air flow therein before and after it leaves said plenum means and enters said spray painting chamber, said plenum means having a total width substantially 60%, or less, than the width of said spray painting chamber, means for controlling air flow from said plenum means substantially into said spray painting chamber for permitting air flow into first portions of said spray painting chamber only where painting occurs and overspray is generated to control the overspray and for substantially reducing air flow from said plenum means into other portions of said spray painting chamber where no spray painting occurs and no overspray is generated, single washer means for cleaning all said air flow and overspray discharged from said spray painting chamber with water flow, said water flow being 50, or less gallons, per minute per lineal foot of the booth floor length, whereby through the quantity of air supplied to the plenum means and spray painting chamber is 75, or less, cubic feet per minute per square foot of booth floor area, the velocity of the air entering the spray painting chamber from said plenum means into said first portions of said spray painting chamber remains high at 300, or more, feet per minute so that the air entering said first portions of the spray painting chamber from the plenum means can control the overspray generated during spray painting, the discharged air flow is cleaned utilizing 50, or less, gallons per lineal foot of the booth floor length, and reduced quantities of both air flow and water flow are utilized.

2. In the paint spray booth of claim 1, wherein said spray painting chamber has means for moving articles to be painted substantially along the center line of said spray painting chamber, said plenum means comprises a pair of plenums which run substantially the full length of the booth, said pair of plenums being separated by a distance in which no air flow is supplied to said spray painting chamber, each of said pair of plenums being spaced away from the other and offset from the centerline of said booth, said pair of plenums being located above the first portions of said spray painting chamber where overspray is generated when the articles are painted.

3. In the paint spray booth of claim 2, wherein the width of said plenums total 60%, or less, than the width of said paint spray booth.

4. In the paint spray booth of claim 3, wherein the width of said plenums totals 60%, or less, than the width of said ceiling of said paint spray booth.

5. In the paint spray booth of claim 1, further comprising one or more adjustable louvers, said one or more adjustable louvers being located below said plenum means for directing the air flow from said plenum means to control the overspray.

6. In the paint spray booth of claim 1, further comprising one or more adjustable scoops, said one or more adjustable scoops being located below said plenum means for directing air flow from said plenum means around said automated spray painting machine to control the overspray.

7. In the paint spray booth of claim 1, further comprising a bay adjacent to said spray painting chamber, said bay being of a length less than that of said spray painting chamber, said bay extending out beyond the ceiling of said booth and said plenum means and accommodating said automated spray painting machine, said plenum means discharging air flow into said bay around said automated spray painting machine, whereby less air flow is required in said booth but yet said automated spray painting machine remains essentially free of overspray.

8. A method of controlling paint overspray in an automated paint spray booth for spray painting a plurality of articles having a plenum, a spray painting chamber with a floor area, a ceiling through which air flow may be selectively passed, single washer means and an automated spray painting machine therein, comprising the steps of:

only admitting air flow at a low volume of 75, or less, cubic feet per minute per square foot of booth floor area and at a high velocity of 300 feet, or more, per minute from the plenum through the ceiling below and into the spray painting chamber at all those portions of the spray painting chamber needing air flow to control overspray, restricting air flow from the plenum into the spray chamber at other portions of the spray painting chamber, flowing the air around the article being painted to carry off the overspray, withdrawing the paint laden air flow from the spray painting chamber into said single washer means, and washing the paint laden air flow withdrawn from the spray painting chamber in said single washer means with water flow of 50, or less, gallons per minute per lineal foot of booth floor, whereby overspray can be controlled by a reduced quantity of air flow and the reduced quantity of air flow cleaned with a reduced quantity of water flow.

9. The method as in claim 8, further comprising the step of:

directing the air from said plenum and through said ceiling around the backside of said automated spray painting machine to keep overspray off said machine.

10. The method as in claim 8, further comprising the step of:

directing the air from said plenum and through said ceiling to keep overspray off of said plurality of articles.

11. The method as in claim 8, further comprising the step of:

directing the air from said plenum and through said ceiling around said automated spray painting machine to keep overspray off said machine.

12. The method as in claim 8 wherein the step of restricting the air comprises the step of permitting no air flow.

13. In an automotive paint spray booth for spray painting automotive articles using moving air to control overspray and subsequently cleaning with water the paint laden air created during spray painting the articles, the booth having a centerline, a length, a floor area, a spray painting chamber with a ceiling, and at least one automated spray painting machine therein for spray painting automotive articles, the improvement comprising means for moving a reduced quantity of high velocity air into said spray painting chamber at a total volume of 75, or less, cubic feet per minute per square foot of booth floor area and at a high velocity of 300, or more, feet per minute, a pair of separated, spaced apart plenums located above said spray painting chamber and said ceiling, each of said pair of separated, spaced apart plenums having a centerline and being offset between four to six feet between the booth centerline and the centerline of each plenum, said pair of separated plenums being located above and in communication with said spray painting chamber for carrying substantially all the air from said means for moving air into the top of said spray painting chamber, said pair of separated plenums having a combined width of 60%, or less, of the width of the ceiling of said spray painting chamber and a total cross-sectional area of 25% or less of the cross-sectional area of said spray painting chamber, substantially no air being admitted into said spray painting chamber from between said pair of separated plenums to maintain the high velocity of the air flow therein, before and after entering said spray painting chamber, means for adjusting the flow of air from said pair of separated plenums to permit flow at a high velocity of 300, or more, feet per minute into said spray painting chamber only where needed to control overspray, and solely single means for discharging paint ladened air out of the bottom of said spray painting chamber and for cleaning said paint ladened air with a reduced flow of water, said reduced flow of water being 50 gallons per minute, or less, per foot of booth length, whereby though the quantity of air supplied to said pair of separated, spaced apart plenums and spray painting chamber is reduced to 75, or less, cubic feet per minute per square foot of booth floor area, the velocity of the air entering the spray painting chamber from said pair of plenums remains high at 300, or more, feet per minute so that the air entering said spray painting chamber can control the overspray generated during spray painting, the water flow for cleaning the air flow can be commensurately reduced to 50 gallons per minute, or less, per foot of booth length, and both reduced air and water flows are achieved.

* * * * *